US005461281A

United States Patent [19]

Fromm et al.

[11] Patent Number: 5,461,281

[45] Date of Patent: Oct. 24, 1995

[54] HIGH-PRESSURE DISCHARGE LAMP WITH A HALIDE FILL INCLUDING LIFE-EXTENDING ADDITIVES

[75] Inventors: Dietrich Fromm, Warngau; Guenter Soehring, Munich; Richard Ullmann, Puchheim, all of Germany

[73] Assignee: Patent-Treuhand-Gesellschaft F. Elektrische Gluehlampem mbH, Munich, Germany

[21] Appl. No.: 271,192

[22] Filed: Jul. 7, 1994

[30] Foreign Application Priority Data

Jul. 30, 1993 [DE] Germany ..... 43 25 679.1

[51] Int. Cl.[6] ..... H01J 61/26

[52] U.S. Cl. ..... 313/556; 313/553; 313/554; 313/639; 313/641

[58] Field of Search ..... 313/556, 553, 313/554, 558, 559, 561, 25, 639, 570, 571, 637, 638, 640, 641, 642; 315/59, 248

[56] References Cited

U.S. PATENT DOCUMENTS

| | | | |
|---|---|---|---|
| 4,015,164 | 3/1977 | Fischer et al. | 313/637 X |
| 4,360,756 | 11/1982 | Spencer et al. | 313/553 |
| 4,633,136 | 12/1986 | Fromm et al. . | |
| 4,859,905 | 8/1989 | White et al. | 313/558 |
| 5,034,656 | 7/1991 | Yu et al. . | |
| 5,239,232 | 8/1993 | Heider et al. | 313/639 |
| 5,363,007 | 11/1994 | Fromm et al. | 313/571 X |

FOREIGN PATENT DOCUMENTS

| | | |
|---|---|---|
| 0119082 | 9/1984 | European Pat. Off. . |
| 2342553 | 9/1977 | France . |
| 110138 | 12/1974 | German Dem. Rep. . |

OTHER PUBLICATIONS

Database WPI, Section Ch, Week 8048, Derwent Publications Ltd., London, GB; Class L03, AN 80–85336C & JP–A–55 133 732 (Tokyo Shibaura El. Ltd) 18. Oct. 1980.

"Technisch–wissenschaftliche Abhandlungen der OSRAM–Gesellschaft" (Technological–scientific papers of the OSRAM company), vol. 12, published by Springer, Berlin, Heidelberg, New York, Tokyo, 1986, pp. 65–72, article by D. C. Fromm: Elektrodenentwicklung für kleine Halogen–Metalldampflampen (Electrode Development for Small for Halogen Metal Vapor Lamps).

*Primary Examiner*—Donald J. Yusko
*Assistant Examiner*—N. D. Patel
*Attorney, Agent, or Firm*—Frishauf, Holtz, Goodman, Langer & Chick

[57] ABSTRACT

To prevent attack on electrodes (4, 5) within a discharge vessel (2) by an ionizable metal halide fill, due to spurious or free oxygen arising within the lamp during operation thereof, which oxygen combines with the metal of the electrodes, and is then dissociated in the arc and re-deposited at the hottest part of the electrode, an oxygen removing getter material is introduced into the discharge vessel. Spurious oxygen arises due to emission of oxygen from the glass wall of the discharge vessel, typically quartz glass, and unavoidable contaminants of the fill substance. The getter material is, preferably, phosphorus, boron or aluminum, a halide of the foregoing, a tungsten boron compound, a tin phosphorus compound, or scandium or a rare earth. If the getter is a halide, iodine, bromine or chloride are suitable. The getter may be introduced in quantities of between 0.05 to 0.6%, depending on the getter substances and the fill composition.

23 Claims, 2 Drawing Sheets

HIGH-PRESSURE DISCHARGE LAMP WITH A HALIDE FILL INCLUDING LIFE-EXTENDING ADDITIVES

Reference to related patents, the disclosures of which are hereby incorporated by reference:

U.S. Pat. No. 4,633,136, Fromm et al

U.S. Pat. No. 5,034,656, Yu et al.

Reference to related disclosure:

"Technisch-wissenschaftliche Abhandlungen der OSRAM-Gesellschaft" ("Technological-scientific papers of the OSRAM company), Vol. 12, published by Springer, Berlin, Heidelberg, New York, Tokyo, 1986, pp. 65–72, article by D. C. Fromm: "Elektrodenentwicklung für kleine Halogen-Metalldampflampen" ("Electrode Development for Small Halogen Metal Vapor Lamps").

FIELD OF THE INVENTION

The present invention relates to high-pressure discharge lamps including a fill which contains halogen, so that the lamp will operate with a halogen cycle, and more particularly to such a lamp which has an extended life.

BACKGROUND

Halogen metal vapor high-pressure discharge lamps have a fill which can ionize. For generation of visible light, the fill uses halides of sodium and/or tin. To use high-pressure halogen metal discharge lamps for medical or technical applications, and all others in which, essentially, radiation should be in the ultraviolet spectral range, the ionizable fill includes one or more halides of mercury, iron and/or nickel.

Lamps having halogens in their fill are subject to two halogen cycles. One of them prevents blackening of the discharge vessel; another halogen cycle, however, occurs which affects the electrode material. This second cycle damages the electrodes and leads to substantial problems of quality in the lamps, due to corrosion of the electrodes or the electrode stems.

The electrode material usually is tungsten or thoriated tungsten. The vaporized tungsten halide or, for example, a tungsten-oxygen halogen combination, dissociates during the discharge. The tungsten which is thus liberated is derived, at least in part, from the electrode and the electrode shaft and precipitates at the hot spots of the electrodes, or on the tip of the electrodes. The electrodes could break by corrosion at a portion of the electrode or electrode shaft which is weakened. Breakage of the electrode, of course, leads to failure of the lamp. FIG. 2 illustrates, schematically, the reaction diagram which leads to electrode corrosion.

Free oxygen ($O_2$), together with tungsten, forms tungsten dioxide ($WO_2$) which reacts with a halogen ($X_2$) in the discharge vessel to form a tungsten oxide halide ($WO_2X_2$). The tungsten oxygen halogen compound dissociates in the discharge, schematically shown at D. The resulting tungsten deposits at the hot spots of the electrodes. The oxygen ($O_2$) and the halogen ($X_2$) are available at the cooler portions of the electrodes, or portions or parts thereof, from which tungsten degradation or removal occurred, providing further electrode material (W) for continuation of the cycle process.

Halogen metal vapor high-pressure discharge lamps which have metal halide fills primarily containing sodium halide or tin halide are particularly affected by this electrode corrosion. Likewise, ultraviolet (UV) radiation sources having metal halide fills which primarily include mercury halides, iron halides and/or nickel halides, likewise are substantially affected.

The problem of electrode corrosion, heretofore, has been solved by adding excess metal to the ionizable fill of the halogen metal vapor lamp. The excess metal binds free halogens, so that the participation of electrode material in the halogen cycle is substantially limited. For example, and using an atomic metal/halogen ratio which is greater than or equal to 1:5, lamp lives of more than 6000 operating hours have been reached. This is described in the referenced publication "Technisch-wissenschaftliche Abhandlungen der OSRAM-Gesellschaft" ("Technological-scientific papers of the OSRAM company), Vol. 12, published by Springer, Berlin, Heidelberg, New York, Tokyo, 1986, pp. 65–72, article by D. C. Fromm: "Elektrodenentwicklung für kleine Halogen-Metalldampflampen" ("Electrode Development for Small Halogen Metal Vapor Lamps").

U.S. Pat. No. 4,633,136, Fromm, assigned to the assignee of the present application, the disclosure of which is hereby incorporated by reference, describes, generally, a halogen metal vapor discharge lamp of the type to which the present invention relates. The ionizable fill in this lamp has an excess of tin in order to prevent electrode corrosion. Further, a surrounding winding protects the electrodes at the cooler regions within the melt connection zone, since these regions are particularly affected by electrode corrosion. The windings surround at least one of the electrode shafts.

THE INVENTION

It is an object to provide a high-pressure metal halide discharge lamp in which electrode corrosion due to attack by halides on the electrodes is suppressed, in a simple and inexpensive manner.

Briefly, a getter material is placed within the discharge vessel which binds spurious or contaminant oxygen which is located within or occurs within the discharge vessel during operation of the lamp.

The getter, in accordance with the present invention, binds any remaining or spurious oxygen which is introduced into the fill within the vessel due to contamination of the fill substances. Further, any oxygen which would be released from the walls of the lamp, due to operating conditions when the lamp is energized. The getter binds the oxygen so that it is no longer available for the cycle illustrated in FIG. 2, that is, the accelerated, catalytic effect of the oxygen on the chemical reaction of the halide with the electrode material no longer pertains. Thus, attack of halides on the electrodes is suppressed, and thus electrode corrosion is inhibited.

An excess of metal in the ionizable fill in order to bind free halogens is also described in U.S. Pat. No. 5,034,656, and in the the above-referenced publication by D. C. Fromm; a protective winding or wrapping is described in the referenced U.S. Pat. No. 4,633,136, Fromm et al. These measures then are no longer needed. Elimination of a protective winding results in a substantial saving in manufacture.

The invention prevents electrode corrosion which decreases the lifetime of discharge lamps containing halogens in their fill. The free halogen can react with the electrode material due to the operating conditions of the electrodes, and their elevated temperature in operation of the lamp. The halogen is derived, entirely or partly, by dissociated metal halide fill components. The oxygen is derived, for example, in form of water, introduced as a contaminant in the fill gas and, under the operating conditions, that is, when the discharge and arc between the electrodes is struck, will dissociate; further, OH groups within the quartz glass of the envelope of the discharge vessel can reach the fill therein. It is the oxygen in the OH groups or in water which is decisive for the damaging effect in the second halogen cycle. Higher oxygen concentrations substantially accelerate electrode corrosion.

Suitable getter substances are, preferably, the chemical elements boron, phosphorus, aluminum, scandium or rare-earth metals, as well as their halides, and the halides are, preferably, iodides, bromides or chlorides. Tungston-boron compounds such as WB and $W_2B$, as well as tin-phosphorus compounds SnP, $SnP_3$, $Sn_4P_3$, may be used. These substances, even in small quantities, bind any remaining oxygen in the discharge vessel and do not influence the color of the light beam emitted and the color locus of the lamp; they also do not lead to damage of the wall of the quartz glass used for the envelope of the discharge vessel. The dosing of the getter substances in the high-pressure discharge lamp according to the present invention is suitably so selected that the proportion, by weight, of the getter substance of the getter compounds which contain the active getter material, such as boron, phosphorus and aluminum, with respect to the overall weight of the metal halide fill in the envelope, amounts to between about 0.05 to 1% by weight, with respect to overall weight of the metal halide fill additives which generate light or radiation. A ratio of 0.05 to 0.5% is preferred.

The weight for dosing of the getter substances in the discharge vessel of the elements boron, phosphorus and aluminum should be between about 0.05 to about 1%, and for their halides 0.1 to 6%, by weight.

Tungsten-boron compounds, such as WB, $W_2B$, and tin-phosphorus compounds preferably use a proportion of weight such that the boron or phosphorus proportion is approximately 0.05 to 1%, by weight.

Scandium and rare-earth metals, suitably use a dosing of between 0.05 to 0.5%; their halides 0.1 to about 6%, all by weight.

All references to percent by weight refer to the metal halide fill additives within the discharge lamp, which serve to provide light or radiation of the lamp.

When using small quantities of getter material, the remaining free oxygen may not be bond completely; adding too much getter substance may lead to blackening of the discharge vessel, or may affect the emission spectrum of the lamp. If the quantity of getter material is excessively high, the halogen cycle which maintains the discharge vessel clean and free from blackening, can also be affected.

The quantity of getter material to be introduced must be so dimensioned that the getter substance does not have any noticeable influence on the emission spectrum and the color locus of the metal halide lamp in accordance with the present invention. This feature becomes particularly important when halides of rare-earth metals are used, which are well known as light and radiation emitting components of fills, and which are also used as getter substances to bind free oxygen. The getter material can easily and preferably be added together with the addition of the metal halide fill additives, which serve to control and determine the light or radiation emission, respectively, for example in form of solid material.

DRAWINGS

FIG. 1 is a highly schematic side view of a double pinch-sealed metal halide discharge lamp in accordance with the present invention; and FIG. 2 is a schematic diagram of a halide cycle leading to electrode corrosion.

DETAILED DESCRIPTION

Figure 1:
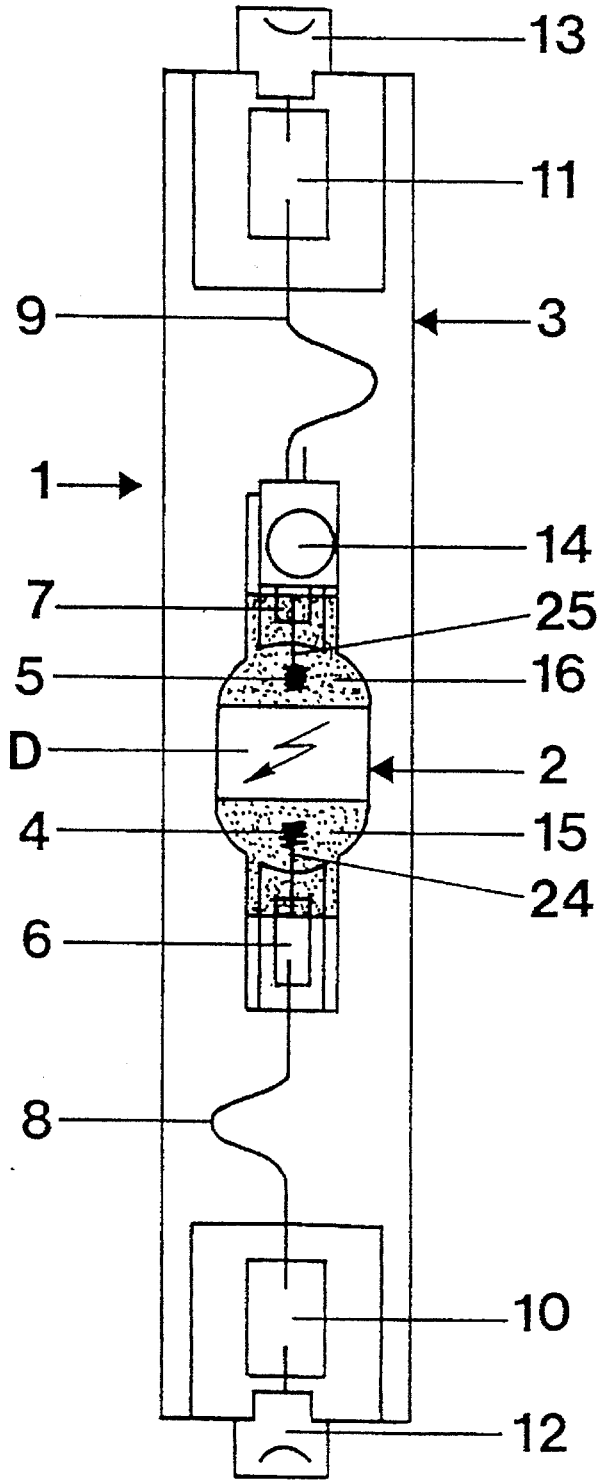
Figure 2:
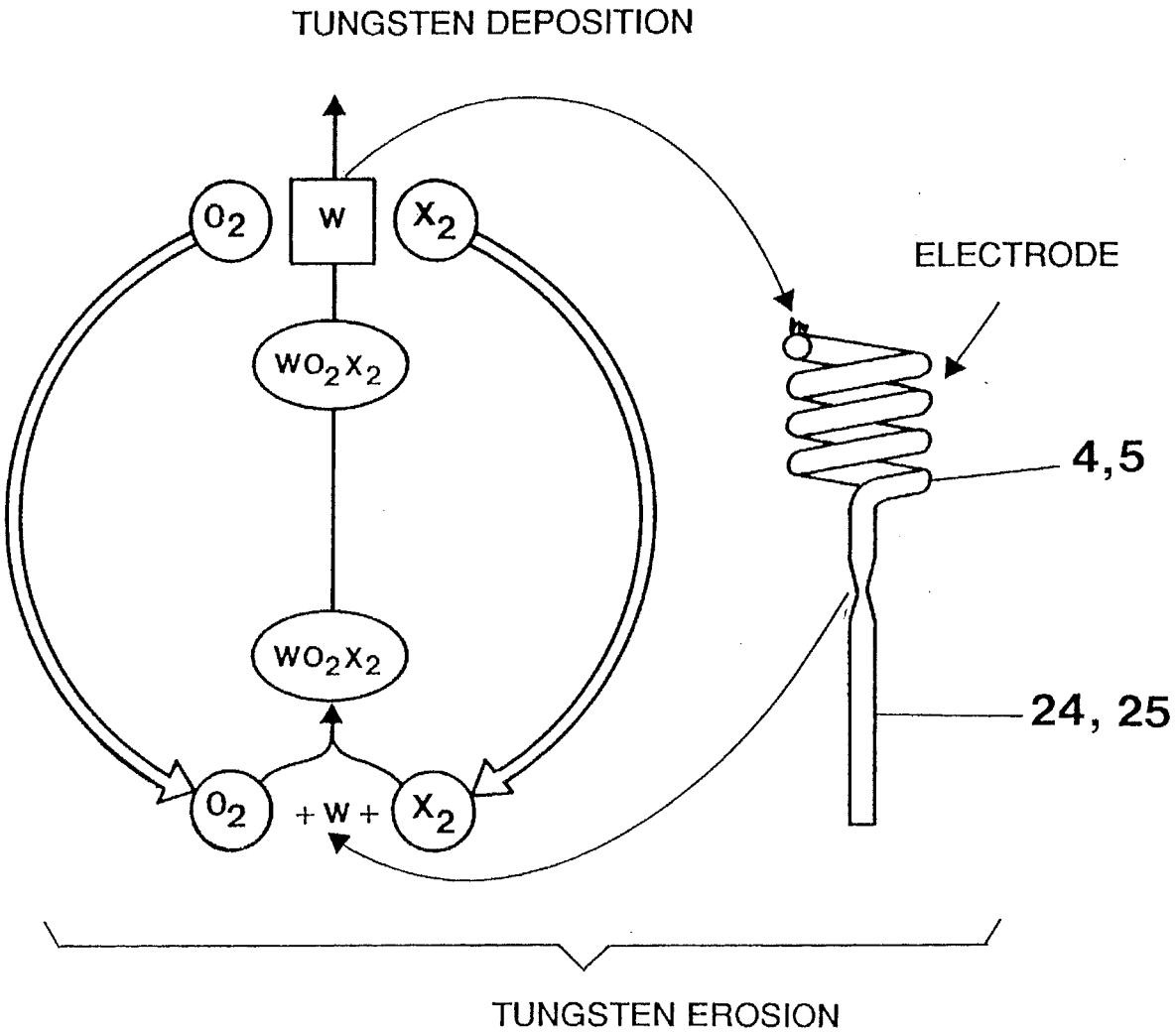

Referring first to FIG. 1: The lamp 1 has a gas-tightly closed discharge vessel 2 of quartz glass, which is surrounded by a transparent outer envelope 3. Two tungsten electrodes 4, 5 are located in the discharge vessel 2, between which a gas discharge will occur when the lamp is energized. The electrodes 4, 5 and shafts 24, 25 are gas-tightly sealed in pinch seals of the discharge vessel 2, and connected over respective molybdenum foils 6, 7 with current supply leads 8, 9. The current supply leads 8, 9 are, in turn, connected to molybdenum foil melt seals 10, 11 within the outer envelope 3 to form a continuous electrical connection between electrical base terminals 12, 13 of the lamp and the respective electrodes 4, 5. A conventional getter 14 is located within the outer envelope 3 secured, for example, to an externally extending, electrically unconnected pin projecting from the discharge vessel 2. A heat reflective or heat damming coating 15, 16 is formed around the ends of the discharge vessel.

The invention will be described in detail with reference to several examples; all the lamps of the examples have basically the same construction as illustrated in FIG. 1.

The first five examples are given with reference to a 70 W metal halide high-pressure discharge lamp emitting warm white light. The getter material is added into the lamp together with the metal halide fill additives in form of solid material, introduced into the discharge vessel 2. The ionizable light emitting fill of the lamp is formed of a noble gas mixture of argon and crypton at 125 mbar, 14.2 mg mercury and 1.4 mg metal halide fill additives.

The metal halide fill contains 33.51% sodium iodide (NaI), 34.96% tin bromide ($SnBr_2$), 23.3% tin iodide ($SnI_2$), 7.8% thallium iodide (TlI) and 0.43% indium iodide (InI). In this, as in all other examples, all percentages are by weight.

The respective examples differ only in the type or quantity of the getter introduced into the lamp.

EXAMPLE 1

In addition to the foregoing, 0.4% phosphorus iodide ($PI_3$) is introduced as a getter substance binding oxygen.

EXAMPLE 2

About 2.0% phosphorus iodide ($PI_3$) are added. The percentage of the getter, of course, relates to the quantity of the metal halide fill additives which provide light emission.

EXAMPLE 3

1.8% boron iodide ($BI_3$) are added as getter.

EXAMPLE 4

5.0% boron iodide ($BI_3$) are added as getter into the discharge vessel 2.

EXAMPLE 5

0.4% aluminum iodide ($AlI_3$) is added as getter substance. Examples 6–9 are directed to a double pinch-sealed 150 W halogen metal vapor high-pressure discharge lamp, emitting light of warm white light color. The construction of the lamp is illustrated in FIG. 1.

The fill of the lamp contains mercury and an ignition gas, such as an argon-crypton noble gas mixture. 2.8 mg of a metal halide, preferably formed as a solid-body additive, is included in the discharge vessel, and forms the metal halide portion of the fill.

The metal halide fill portion contains 41.93% tin iodide ($SnI_2$), 25.32% sodium iodide (NaI), 17.41% sodium bromide (NaBr), 12.66% thallium iodide (TlI), 1.34% indium iodide (InI) and 1.34% lithium bromide (LiBr). All percentages by weight. The following getter substances are added:

EXAMPLE 6

0.4% phosphorus iodide ($PI_3$).

EXAMPLE 7

1.8% boron iodide ($BI_3$).

EXAMPLE 8

0.4% aluminum iodide ($AlI_3$).

EXAMPLE 9

A tin phosphorus compound SnP is added. 2.16% SnP with reference to the entire weight of the metal halide compound is added, corresponding to a phosphorus portion of about 0.5%, as before, by weight.

In all the examples, neither a blackening of the discharge vessel due to excess getter material, nor premature failure due to electrode corrosion could be observed.

The invention is not restricted to the examples listed. For example, iodides of aluminum, boron, phosphorus, as well as their bromides or chlorides could be used. Scandium halide or halides of rare-earth metals, particularly iodides, bromides and chlorides, are also suitable getter substances. It is also possible, rather than using the above-referred to getter compounds, to use substances of aluminum, phosphorus, boron, scandium and rare-earth metals in elementary form. The rare-earth metals, or rare-earth metal halides, as well as scandium or scandium halides, are used in such small quantities that the emission spectrum is not noticeably affected. Particularly, the color temperature is not affected. Experiments have also shown that tungsten-boron compounds WB and $W_2B$ can be used successfully as oxygen getters.

The getter substances above referred to can be used also in metal halide vapor radiation lamps which emit radiation primarily in the UV region. The ionizable fill of such UV radiators includes, besides mercury and a noble gas mixture, metal halide additives which primarily contain metal halides of mercury, iron or nickel, in which the halogen is usually iodine or bromine.

Various changes and modifications may be made, and any features described herein may be used with any of the others, within the scope of the inventive concept.

We claim:

1. A high-pressure discharge lamp having a fill including life extending additives, said lamp having a discharge vessel (2);

spaced electrodes (4, 5) located in the discharge vessel and defining an arc or discharge path (D) between said electrodes, and gas-tightly retained in the discharge vessel; and an ionizable fill located within the discharge vessel which, in operation of the lamp, emits radiation, and comprising, in accordance with the invention, a getter material within the discharge vessel which binds spurious or contaminant oxygen occurring within the discharge vessel (2) to prevent attack of said oxygen on the material of the electrodes, said attack resulting from combination of said oxygen with the material of the electrodes, and subsequent dissociation of said combination in the discharge arc or discharge path, wherein the getter material includes at least one of the elements of the group consisting of: phosphorus, boron and aluminum;

and wherein the quantity of the getter material, with respect to the metal halide fill emitting the radiation, is between about 0.05 to 6%, by weight.

2. The lamp of claim 1, wherein the ionizable fill comprises at least one halide of the metals sodium or tin and, optionally, further halides of metals other than sodium tin.

3. The lamp of claim 1, wherein the ionizable fill comprises at least one halide of the metals mercury, iron or nickel and, optionally, further halides of metals other than mercury, iron or nickel.

4. The lamp of claim 1, wherein the quantity of the getter material, with respect to the metal halide fill emitting the radiation, is between about 0.05 to 1%, by weight.

5. A high-pressure discharge lamp having a fill including life extending additives, said lamp having a discharge vessel (2);

spaced electrodes (4, 5) located in the discharge vessel and defining an arc or discharge path (D) between said electrodes, and gas-tightly retained in the discharge vessel; and an ionizable fill located within the discharge vessel which, in operation of the lamp, emits radiation, and comprising, in accordance with the invention, a getter material within the discharge vessel which binds spurious or contaminant oxygen occurring within the discharge vessel (2) to prevent attack of said oxygen on the material of the electrodes, said attack resulting from combination of said oxygen with the material of the electrodes, and subsequent dissociation of said combination in the discharge arc or discharge path, wherein the getter material essentially consists of halides of at least one of the elements of the group consisting of phosphorus, boron and aluminum;

and wherein the quantity of the getter material, with respect to the metal halide fill emitting the radiation, is between about 0.1 to 6%, by weight.

6. The lamp of claim 5, wherein the halogen of the halide is at least one of iodide, bromine and chloride.

7. The lamp of claim 5, wherein the ionizable fill comprises at least one halide of the metals sodium, tin, mercury, iron, or nickel.

8. A high-pressure discharge lamp having a fill including life extending additives, said lamp having a discharge vessel (2);

spaced electrodes (4, 5) located in the discharge vessel and defining an arc or discharge path (D) between said electrodes, and gas-tightly retained in the discharge vessel; and an ionizable fill located within the discharge vessel which, in operation of the lamp, emits radiation, and comprising, in accordance with the invention, a getter material within the discharge vessel which binds spurious or contaminant oxygen occurring within the discharge vessel (2) to prevent attack of said oxygen on the material of the electrodes, said attack resulting from combination of said oxygen with the material of the electrodes, and subsequent dissociation of said combination in the discharge arc or discharge path, wherein the getter material essentially consists of a tungsten-boron compound, optionally WB, $W_2B$;

and wherein the quantity of getter material, with respect to the ionizable fill within the discharge vessel which emits the radiation is present between about 0.05 to 1%, by weight

9. The lamp of claim 8, wherein the ionizable fill comprises at least one halide of the metals sodium and tin and, optionally, further halides of metals other than sodium and tin.

10. The lamp of claim 8, wherein the ionizable fill comprises at least one halide of the metals mercury, iron and nickel and, optionally, halides of metals other than mercury, iron and nickel;

and wherein the quantity of getter material, with respect to the ionizable fill within the discharge vessel which emits the radiation is present between about 0.05 to 1%, by weight.

11. The lamp of claim 8, wherein the ionizable fill comprises at least one halide of the metals sodium, tin, mercury, iron, or nickel.

12. A high-pressure discharge lamp having a fill including life extending additives, said lamp having a discharge vessel (2);

spaced electrodes (4, 5) located in the discharge vessel and defining an arc or discharge path (D) between said electrodes, and gas-tightly retained in the discharge vessel; and an ionizable fill located within the discharge vessel which, in operation of the lamp, emits radiation, and comprising, in accordance with the invention, a getter material within the discharge vessel which binds spurious or contaminant oxygen occurring within the discharge vessel (2) to prevent attack of said oxygen on the material of the electrodes, said attack resulting from combination of said oxygen with the material of the electrodes, and subsequent dissociation of said combination in the discharge arc or discharge path, wherein the getter material essentially consists of tin-phosphorus compound, optionally SnP, $SnP_3$, $Sn_4P_3$;

and wherein the quantity of getter material, with respect to the ionizable fill within the discharge vessel which emits the radiation is present between about 0.05 to 1%, by weight.

13. The lamp of claim 12, wherein the ionizable fill comprises at least one halide of the metals mercury, iron and nickel and, optionally, halides of metals other than mercury, iron and nickel.

14. The lamp of claim 12, wherein the ionizable fill comprises at least one halide of the metals sodium, tin, mercury, iron, or nickel.

15. A high-pressure discharge lamp having a fill including life extending additives, said lamp having a discharge vessel (2);

spaced electrodes (4, 5) located in the discharge vessel and defining an arc or discharge path (D) between said electrodes, and gas-tightly retained in the discharge vessel; and an ionizable fill located within the discharge vessel which, in operation of the lamp, emits radiation, and comprising, in accordance with the invention, a getter material within the discharge vessel which binds spurious or contaminant oxygen occurring within the discharge vessel (2) to prevent attack of said oxygen on the material of the electrodes, said attack resulting from combination of said oxygen with the material of the electrodes, and subsequent dissociation of said combination in the discharge arc or discharge path, wherein the getter material essentially consists of scandium or a rare-earth metal;

and wherein the quantity of the getter material, with respect to the metal halide fill emitting the radiation, is between about 0.05 and 6%, by weight.

16. The lamp of claim 15, wherein the quantity of the getter material is between about 0.05 and 0.5%, by weight.

17. the lamp of claim 15, wherein the ioizable fill comprises at least one halide of the metals mercury, iron and nickel and, optionally, halides of metals other than mercury, iron and nickel.

18. The lamp of claim 15, wherein the ionizable fill comprises at least one halide of the metals sodium, tin, mercury, iron or nickel.

19. A high-pressure discharge lamp having a fill including life extending additives, said lamp having a discharge vessel (2);

spaced electrodes (4, 5) located in the discharge vessel and defining an arc or discharge path (D) between said electrodes, and gas-tightly retained in the discharge vessel; and an ionizable fill located within the discharge vessel which, in operation of the lamp, emits radiation, and comprising, in accordance with the invention, a getter material within the discharge vessel which binds spurious or contaminant oxygen occurring within the discharge vessel (2) to prevent attack of said oxygen on the material of the electrodes, said attack resulting from combination of said oxygen with the material of the electrodes, and subsequent dissociation of said combination in the discharge arc or discharge path, wherein the getter material essentially consists of a scandium halide or a halide of rare-earth metals;

and wherein the quantity of the getter material, with respect to the metal halide fill emitting the radiation, is between about 0.1 to 6%, by weight.

20. The lamp of claim 19, wherein the halogen of the halide is at least one of iodide, bromine and chloride.

21. The lamp of claim 19, wherein the ionizable fill comprises at least one halide of the metals sodium, tin, mercury, iron, or nickel.

22. A high-pressure discharge lamp having a fill including life extending additives, said lamp having a discharge vessel (2);

spaced electrodes (4, 5) located in the discharge vessel and defining an arc or discharge path (D) between said electrodes, and gas-tightly retained in the discharge vessel; and an ionizable fill located within the discharge vessel which, in operation of the lamp, emits radiation, and comprising, in accordance with the invention, a getter material within the discharge vessel which binds spurious or contaminant oxygen occurring within the discharge vessel (2) to prevent attack of said oxygen on the material of the electrodes, said attack resulting from combination of said oxygen with the material of the electrodes, and subsequent dissociation of said combination in the discharge arc or discharge path, wherein the getter material includes at least one of the elements of the group consisting of phosphorus boron, aluminum, a tungsten boron compound, optionally WB and $W_2B$, a tin-phosphorus compound, optionally SnP, $SnP_3$, $Sn_4P_3$, scandium or a rare-earth metal, a halide of at least one of the elements of the group consisting of phosphorus, boron, aluminum, scandium halide, or a halide of rare-earth metals; and wherein the quantity of the getter material, with respect to the metal-halide fill emitting the radiation is between about 0.05 to 6%, by weight.

23. The lamp of claim 22, wherein the ionizable fill comprises at least one halide of the metals sodium, tin, mercury, iron or nickel.

* * * * *